US009671070B2

(12) United States Patent
Wu et al.

(10) Patent No.: US 9,671,070 B2
(45) Date of Patent: Jun. 6, 2017

(54) LED SPHERICAL LAMP

(71) Applicant: UNITY OPTO TECHNOLOGY CO., LTD., New Taipei (TW)

(72) Inventors: Chih-Hsien Wu, New Taipei (TW); Sen-Yuh Tsai, New Taipei (TW); Chun-Chieh Huang, New Taipei (TW); Yu-Chang Chen, New Taipei (TW)

(73) Assignee: Unity Opto Technology Co., Ltd., New Taipei (TW)

( * ) Notice: Subject to any disclaimer, the term of this patent is extended or adjusted under 35 U.S.C. 154(b) by 173 days.

(21) Appl. No.: 14/692,888

(22) Filed: Apr. 22, 2015

(65) Prior Publication Data

US 2016/0273714 A1 Sep. 22, 2016

(30) Foreign Application Priority Data

Mar. 20, 2015 (TW) ..... 104204194

(51) Int. Cl.

| | |
|---|---|
| ***F21S 4/00*** | (2016.01) |
| ***F21K 9/278*** | (2016.01) |
| ***F21K 9/232*** | (2016.01) |
| ***H01R 33/945*** | (2006.01) |
| *F21V 23/06* | (2006.01) |
| *F21V 23/00* | (2015.01) |
| *F21Y 115/10* | (2016.01) |
| *H01R 33/76* | (2006.01) |

(52) U.S. Cl.

CPC ..... *F21K 9/278* (2016.08); *F21K 9/232* (2016.08); *F21V 23/003* (2013.01); *F21V 23/004* (2013.01); *H01R 33/9453* (2013.01); *F21V 23/006* (2013.01); *F21V 23/06* (2013.01); *F21Y 2115/10* (2016.08); *H01R 33/7642* (2013.01)

(58) Field of Classification Search

CPC ..... F21V 23/005; F21V 19/0065; F21V 19/0005; F21V 19/001; F21V 19/0015; F21V 19/0025; F21V 19/007; F21K 9/232; F21K 9/278

USPC ..... 362/249.02

See application file for complete search history.

(56) References Cited

U.S. PATENT DOCUMENTS

2015/0181657 A1* 6/2015 Chen ..... H05B 33/0803 315/294

* cited by examiner

*Primary Examiner* — Anh Mai
*Assistant Examiner* — Matthew Peerce
(74) *Attorney, Agent, or Firm* — Rosenberg, Klein & Lee

(57) ABSTRACT

An LED spherical lamp includes a base, a power supply unit, a substrate and a cover. The power supply unit is installed inside the base, and the substrate has plural LED light emitting elements and is coupled to a side of the base, and the cover is fixed to the base for covering the substrate. The LED spherical lamp includes an electrical connector installed to the substrate and having a plurality of electrical terminals for electrically connecting the substrate to the power supply unit, and an engaging slot is concavely formed on a side of the electrical connector, such that the power supply unit drives the LED light emitting elements to achieve the lighting effect. The LED spherical lamp has the effects of simplifying the assembling and manufacturing procedure, assuring the electrical conduction of components, and facilitating the maintenance, repair, and replacement of the components.

4 Claims, 4 Drawing Sheets

LED SPHERICAL LAMP

CROSS-REFERENCE TO RELATED APPLICATIONS

This non-provisional application claims priority under 35 U.S.C. §119(a) on Patent Application No(s). 104204194 filed in Taiwan, R.O.C. on Mar. 20, 2015, the entire contents of which are hereby incorporated by reference.

BACKGROUND OF THE INVENTION

1. Field of the Invention

The present invention relates to the field of LED lamps, and more particularly to an LED spherical lamp having the features of simple manufacturing process, easy installation, excellent electrically conductive status, and easy maintenance.

2. Description of the Related Art

At present, most lights and lamps use light emitting diodes (LEDs) as a primary light source, and various types of lamps such as ceiling lights, down lamps, ceiling lamps and spherical lamps are available for different lighting effects and purposes and used extensively in daily life.

Among the spherical lamps, LED spherical lamps with the advantages of environmental protection, energy saving, and long service life gradually replace the traditional tungsten lamps. In general, a conventional LED spherical lamp includes a base, a power supply unit, a substrate and a cover, and the base is provided for placing the power supply unit, and the substrate is connected to a side of the base and electrically coupled to the power supply unit, and the cover is covered on the top of the substrate and fixed to the base. Wherein, the substrate includes a plurality of LED light emitting elements, and the manufacturing process requires a positive terminal and a negative terminal extended from the power supply unit and soldered to the substrate for the electrical conduction with the power supply unit, so that the LED light emitting elements installed on the substrate can receive electric power to generate light. In order to receive power, the LED light emitting elements require the aforementioned step in the assembling process, and thus not just incurring greater manufacturing time and cost only, but also having an issue of disconnecting the positive and negative terminals from a conductive circuit easily and affecting the operation of the LED light emitting elements. When a related component such as the substrate, the LED light emitting elements and the power supply unit are damaged, it is necessary to remove all components before replacing the damaged component. Obviously, the conventional LED spherical lamps are inconvenient. Particularly, when the power supply unit is damaged, anew set of positive and negative terminals is required.

In view of the aforementioned drawbacks of the conventional spherical lamps, the inventor invented an LED spherical lamp using an electrical connector for the electrical conduction to simplify the manufacture and maintenance of the LED spherical lamp.

SUMMARY OF THE INVENTION

Therefore, it is a primary objective of the present invention to provide an LED spherical lamp having the effects of simplifying the assembling and manufacturing procedure, keeping an excellent electrical conduction status, and facilitating the maintenance, repair and replacement of a damaged LED spherical lamp.

To achieve the aforementioned and other objectives, the present invention provides an LED spherical lamp, comprising a base for installing a power supply unit, a substrate and a cover therein, and the power supply unit being installed inside the base, and the substrate having a plurality of LED light emitting elements and coupled to a side of the base, and the cover being fixed to the base for covering the substrate therein, characterized in that the LED spherical lamp further comprises an electrical connector installed to the substrate and having a plurality of electrical terminals for electrically connecting the substrate to the power supply unit, and an engaging slot concavely formed on a side of the electrical connector, so that the power supply unit and the substrate may form a current path to drive the LED light emitting elements.

Wherein, each electrical terminal includes at least one first pin terminal and at least one second pin terminal, and the first pin terminal is installed in the engaging slot and conducted with the power supply unit, and the second pin terminal is extended and protruded from an outer side of the electrical connector, and a sidewall of the engaging slot has a plurality of first latch slots corresponsive to the first pin terminals for receiving the first pin terminals respectively. Preferably, the latch slots are arranged equidistantly and opposite to the sidewall of the engaging slot, wherein the first pin terminals are installed in pairs. In addition, each pair of the second pin terminals is also arranged equidistantly on the opposite side of the electrical connector and symmetrically with respect to the first pin terminals.

In addition, the electrical connector further includes a pair of limit portions disposed opposite to an outer side of the electrical connector, and a side of each limit portion has a plurality of second latch slots corresponsive to the second pin terminals and provided for fixing the second pin terminals respectively, and the other side of each limit portion abuts a plane of the substrate when the electrical connector is installed to the substrate, so as to achieve the position limiting effect.

In summation, the LED spherical lamp of the present invention not just simplifies the overall assembling and manufacturing procedure of the lamp only, but also assures a good electrical conduction of the power supply unit with the substrate and the LED light emitting elements through the electrical connector, prevents poor contacts, and provides a simple, easy and quick replacement for damaged components or electric driving problems.

DETAILED DESCRIPTION OF THE PREFERRED EMBODIMENTS

Figure 1:
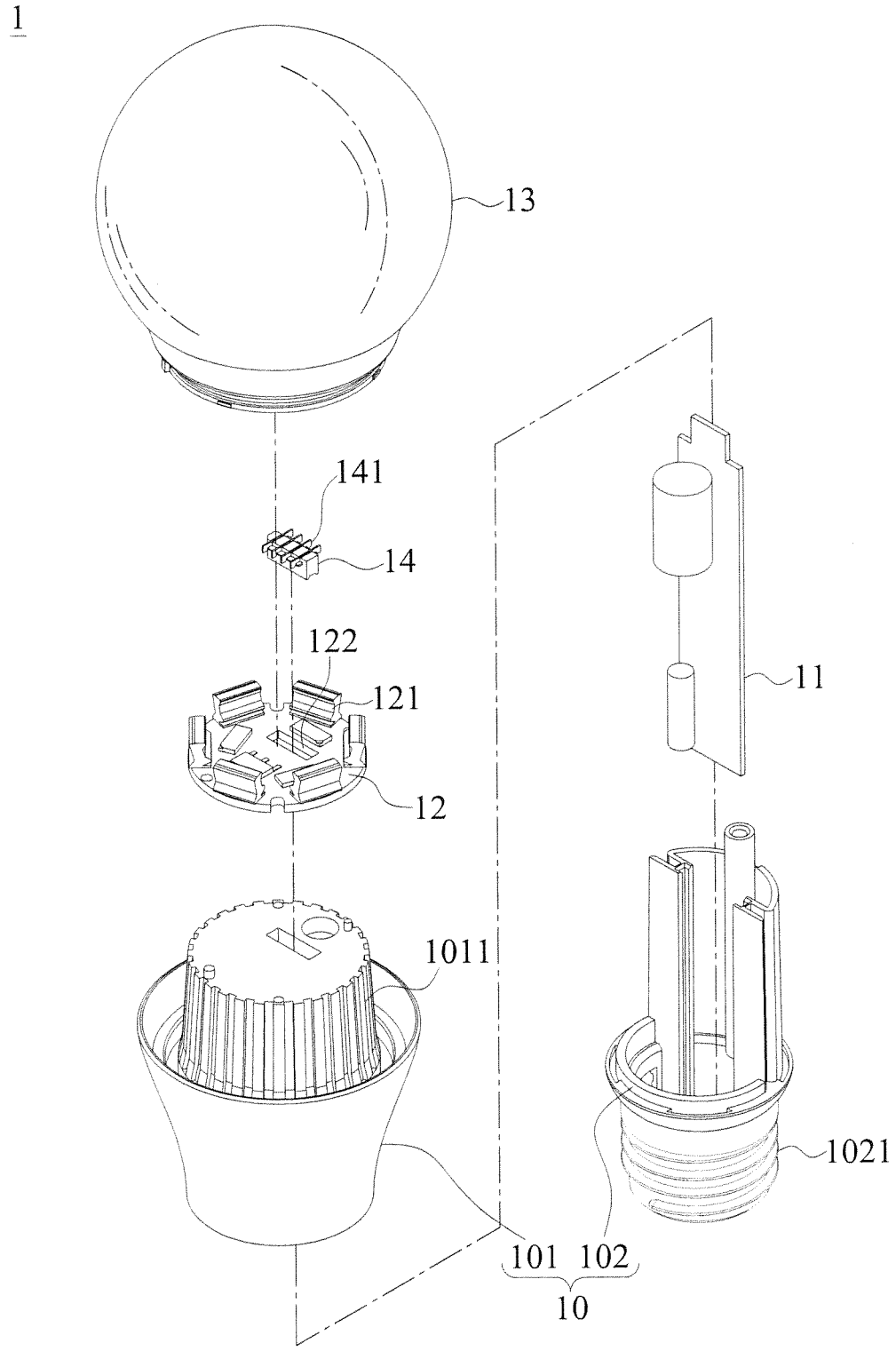
FIG. 1 is an exploded view of a preferred embodiment of the present invention.

The technical content of the present invention will become apparent with the detailed description of preferred embodiments and the illustration of related drawings as follows.

With reference to FIGS. 1, 2-3 and 4A-4B for the exploded view, the first and second perspective views of an electrical connector, the cross-sectional view of assembling an LED spherical lamp, and the partial blowup view of the LED spherical lamp in accordance with a preferred embodiment of the present invention respectively, the LED spherical lamp 1 comprises a base 10 for installing an power supply unit 11, a substrate 12 and a cover 13 therein, and the power supply unit 11 is installed inside the base 10, and the substrate 12 includes a plurality of LED light emitting elements 121 and is coupled to aside of the base 10, and the cover 13 is fixed to the base 10 for covering the substrate 12. Wherein, the base 10 has a first carrying portion 101 and a second carrying portion 102 engaged with each other to form the base 10 for covering the power supply unit 11, and the first carrying portion 101 has a cooling portion 1011 and the top of the first carrying portion 101 is provided for connecting the substrate 12, and the second carrying portion 102 has an electrical fitting 1021 provided for electrically connecting the power supply unit 11 and an external power supply (not shown in the figure) to supply electric power to the power supply unit 11, and the cooling portion 1011 is provided for dissipating the heat generated by the operation of the LED spherical lamp 1.

Figure 2:
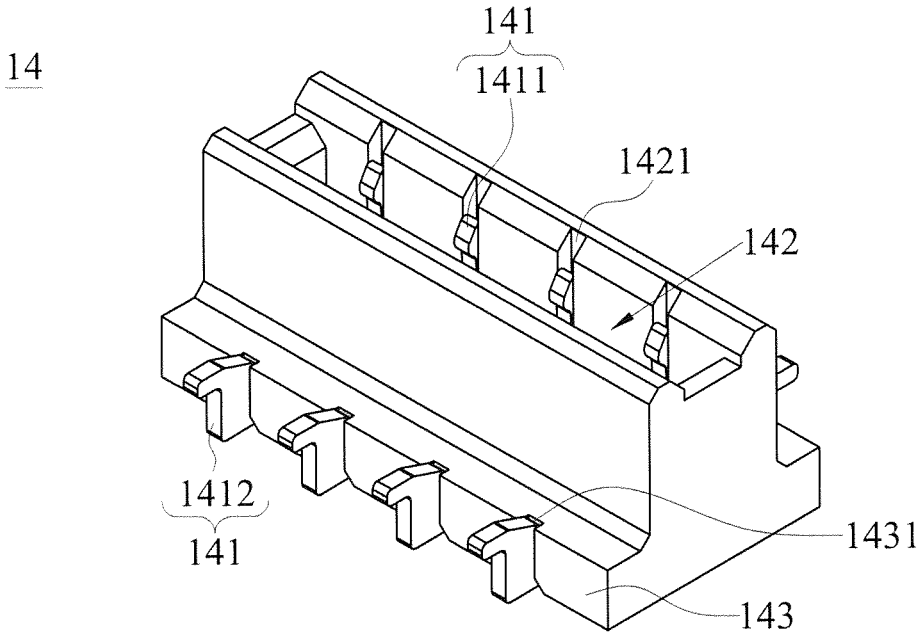
FIG. 2 is a first perspective view of an electrical connector of a preferred embodiment of the present invention.
Figure 3:
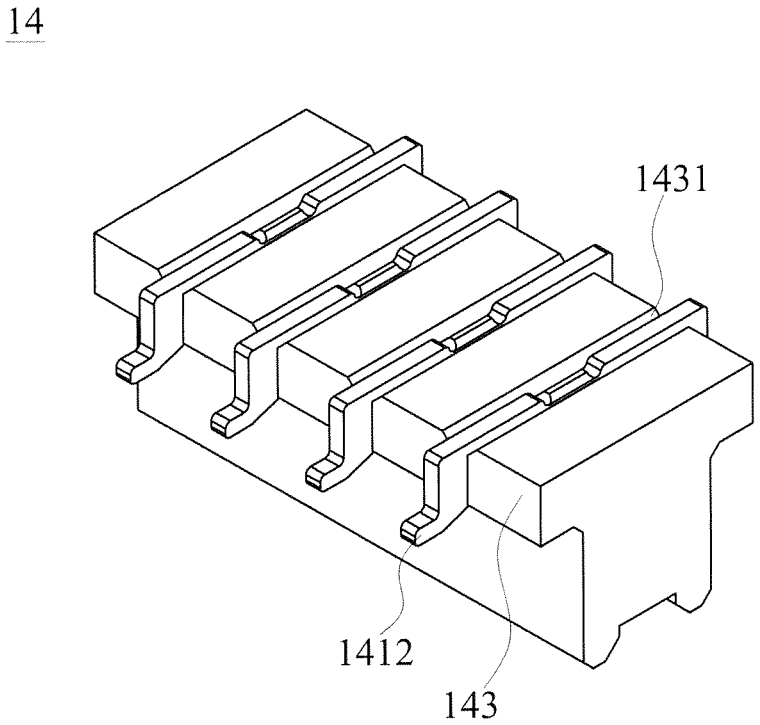
FIG. 3 is a second perspective view of an electrical connector of a preferred embodiment of the present invention.
Figure 4A:
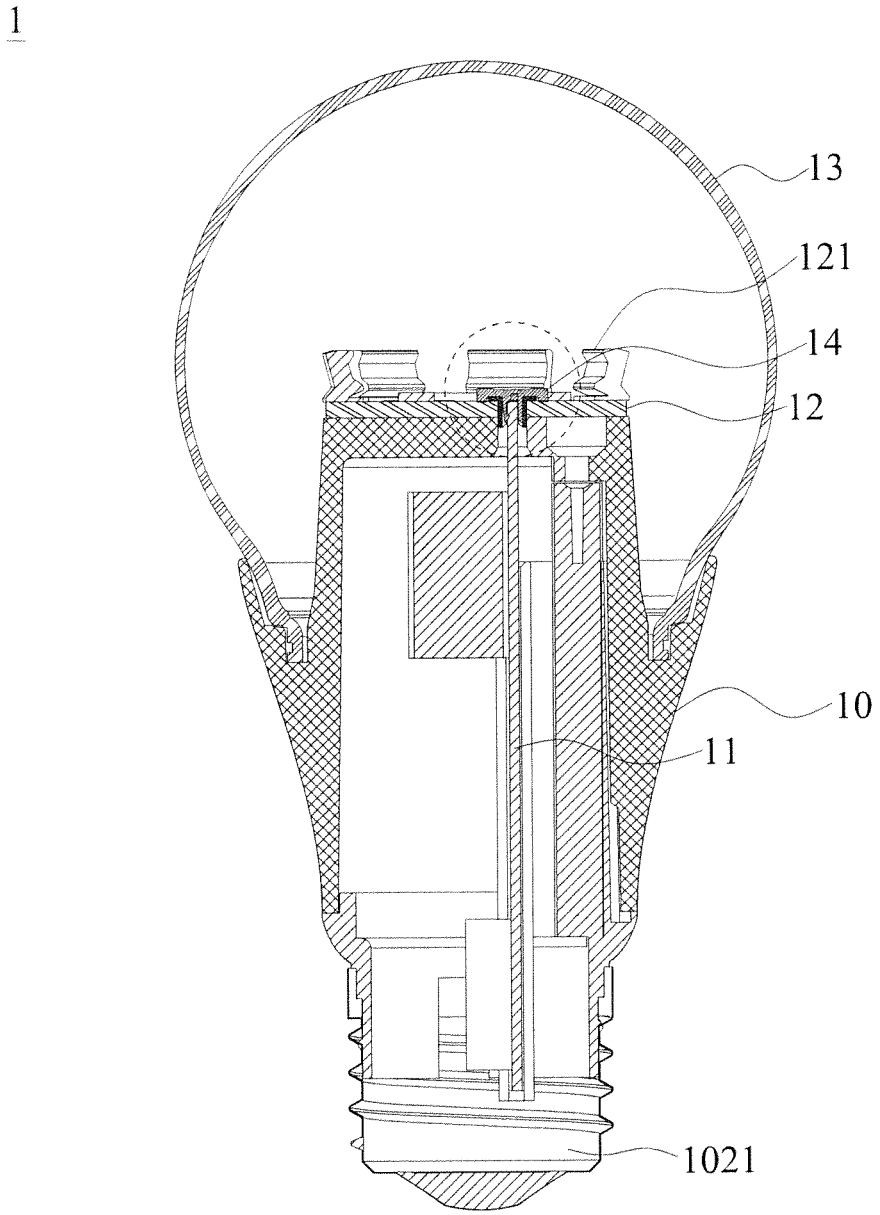
FIG. 4A is a cross-sectional view of assembling a spherical lamp of a preferred embodiment of the present invention.
Figure 4B:
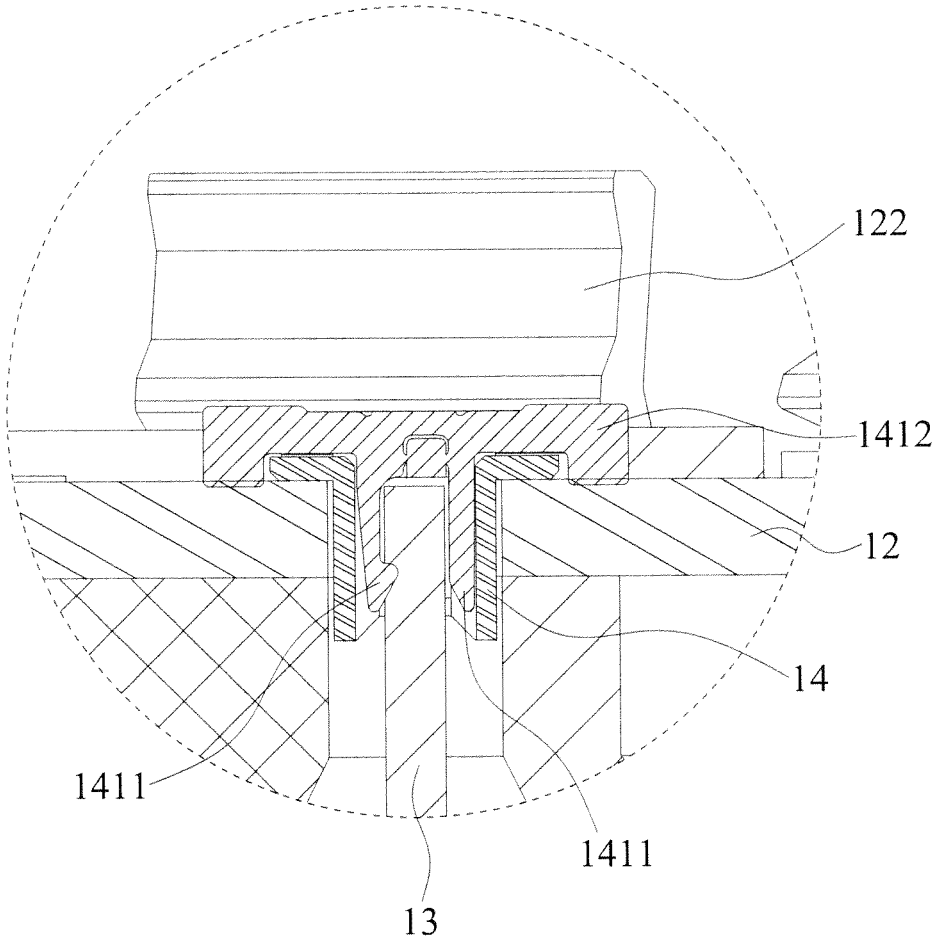
FIG. 4B is a partial blowup view after a spherical lamp is installed according to a preferred embodiment of the present invention.

The LED spherical lamp 1 further comprises an electrical connector 14 fixed to the substrate 12, and the electrical connector 14 includes a plurality of electrical terminals 141 for electrically connecting the substrate 12, and an engaging slot 142 is concavely formed on a side of the electrical connector 14 so as to connect to the power supply unit 11, so that the power supply unit 11 and the substrate 12 form a current path to drive the LED light emitting elements 121. Preferably, the electrical connector 14 is a rectangular structure, and the substrate 12 has an installing hole 122 corresponsive to the electrical connector 14, and each electrical terminal 141 has at least one first pin terminal 1411 and at least one second pin terminal 1412, and the first pin terminals 1411 are disposed in the engaging slot 142 and contacted with the power supply unit 11, and the second pin terminals 1412 are extended and protruded from the outer side of the electrical connector 14. In this preferred embodiment, each electrical terminal has a pair of first pin terminals and a pair of second pin terminals as shown in FIGS. 2 and 3. To position and fix the first pin terminals 1411 accurately, a sidewall of the engaging slot 142 has a plurality of first latch slots 1421 corresponsive to the first pin terminals 1411 respectively. Preferably, the first latch slots 1421 are arranged equidistantly on the sidewall of the engaging slot 142, so that the first pin terminals 1411 are arranged corresponsive to the first latch slots 1421 as shown in FIG. 2, and the first pin terminals 1411 are disposed on two opposite sides of the engaging slot 142 respectively, and the first pin terminal 1411 on one side serves as a positive contact, and the first pin terminal 1411 on the other side serves as a negative contact. Similarly, the second pin terminals 1412 are arranged equidistantly on opposite sides of the electrical connector 14 and electrically coupled to the substrate 12, so that the current of the power supply unit 11 can be transmitted to the substrate 12 to drive the LED light emitting elements 121.

In addition, the electrical connector 14 further includes a pair of limit portions 143 disposed on the outer side of the electrical connector 14, and a side of each limit portion 143 has a plurality of second latch slots 1431 corresponsive to the second pin terminals 1412 for fixing the second pin terminals 1412, and abutting a plane of the substrate 12 when the electrical connector 14 on the other side is installed on the substrate 12, so as to limit the vertical height of the electrical connector 14 with respect to the plane of the substrate 12. When the electrical connector 14 is installed to the installing hole 122 of the substrate 12, the pair of limit portions 143 abuts against the plane of the substrate 12 to achieve the effect of limiting the position of the electrical connector 14.

In the assembling process of the LED spherical lamp of the present invention, the power supply unit 11 is installed in the base 10, and the substrate 12 is installed at the top of the base 10, and then the electrical connector 14 is connected to the installing hole 122, so that the engaging slot 142 and the power supply unit 11 are connected. In the meantime, the first pin terminals 1411 are electrically coupled to the power supply unit 11, and the second pin terminals 1412 are electrically coupled to the substrate 12, so that the electrical connector 14 may serve as a bridge for transmitting current from the power supply unit 11 to the substrate 12, and then the cover 13 is covered onto the top of the substrate 12 and fixed to the base 10, so as to complete the assembling of the LED spherical lamp 1.

In summation of the description above, the LED spherical lamp 1 of the present invention simplifies the whole assembling procedure significantly without requiring any extra manufacturing step for the electrical conduction and assembles related components easily. Since a side of the electrical connector 14 has the engaging slot 142 to assure the electrical conduction between the first pin terminals 1411 and the power supply unit 11, and the other side of the electrical connector 14 has the second pin terminals 1412 protruded from the electrical connector 11 electrically coupled to the substrate 12, an excellent electric connection of the LED spherical lamp 1 is maintained, unlike the conventional spherical lamp frequently having the issue of poor contacts due to soldering or a poor yield rate of the LED spherical lamp 1. Compared with the conventional spherical lamp, the present invention uses the electrical connector 14 as a bridge for conducting current and provides a simple, easy and quick maintenance, repair, or replacement for damaged components or electric driving problems.

What is claimed is:

1. An LED spherical lamp, comprising a base, a power supply unit, a substrate and a cover therein, and the power supply unit being installed inside the base, and the substrate having a plurality of LED light emitting elements and being coupled to a side of the base, and the cover being fixed to the base for covering the substrate therein, characterized in that the LED spherical lamp further comprises an electrical connector installed to the substrate and having a plurality of electrical terminals for electrically coupling the substrate to the power supply unit, and an engaging slot concavely formed on a side of the electrical connector to fix to the power supply unit, such that the power supply unit and the substrate form a current path to drive the LED light emitting elements, wherein the substrate has an installing hole corresponsive to the electrical connector, each electrical terminal includes at least one first pin terminal and at least one second pin terminal, and the first pin terminal is disposed in the engaging slot and conducted with the power supply unit, and the second pin terminal is extended and protruded from an outer side of the electrical connector, wherein the electrical connector further includes a pair of limit portions disposed on opposite sides of an outer side of the electrical connector, and a side of each limit portion has a plurality of second latch slots corresponsive to the second pin terminals respectively and provided for fixing the second pin terminals, and the other side of each limit portion abuts a plane of the substrate when the electrical connector is installed to the substrate.

2. The LED spherical lamp according to claim 1, wherein a sidewall of the engaging slot has a plurality of first latch slots corresponsive to the first pin terminals respectively.

3. The LED spherical lamp according to claim 2, wherein the first latch slots are arranged equidistantly and installed opposite to each other on the sidewall of the engaging slot.

4. The LED spherical lamp according to claim 3, wherein the second pin terminals are equidistantly arranged on an opposite side of the electrical connector.

* * * * *